US007024909B2

(12) United States Patent
Cobzaru et al.

(10) Patent No.: US 7,024,909 B2
(45) Date of Patent: Apr. 11, 2006

(54) NON-IMPACT SWAGING APPARATUS

(75) Inventors: Cristinel Ovidiu Cobzaru, Murrieta, CA (US); Robert Bryant, Anaheim, CA (US)

(73) Assignee: Alcoa Global Fasteners, Inc., Torrance, CA (US)

( * ) Notice: Subject to any disclaimer, the term of this patent is extended or adjusted under 35 U.S.C. 154(b) by 317 days.

(21) Appl. No.: 10/690,409

(22) Filed: Oct. 21, 2003

(65) Prior Publication Data

US 2005/0081595 A1 Apr. 21, 2005

(51) Int. Cl.
*B21D 41/02* (2006.01)

(52) U.S. Cl. ..... 72/393; 72/391.2; 72/370.07; 29/507; 29/522.1

(58) Field of Classification Search ..... 72/393, 72/392, 391.2, 391.4, 370.06, 370.07; 29/522.1, 29/523, 507, 451

See application file for complete search history.

(56) References Cited

U.S. PATENT DOCUMENTS

| | | | | |
|---|---|---|---|---|
| 2,360,054 | A | | 10/1944 | Haas |
| 2,394,341 | A | | 2/1946 | Strong |
| 3,888,102 | A | | 6/1975 | Nigido |
| 4,557,033 | A | | 12/1985 | Champoux |
| 4,694,677 | A | | 9/1987 | Rabe |
| 4,776,198 | A | | 10/1988 | Kerrey |
| 4,779,445 | A | | 10/1988 | Rabe |
| 4,934,038 | A | | 6/1990 | Caudill |
| 5,022,254 | A | | 6/1991 | Kramer |
| 5,103,548 | A | * | 4/1992 | Reid et al. ..... 29/507 |
| 5,125,324 | A | | 6/1992 | Araki |
| 5,433,100 | A | * | 7/1995 | Easterbrook et al. ..... 72/391.2 |
| 5,761,810 | A | | 6/1998 | Insalaco et al. |

FOREIGN PATENT DOCUMENTS

| | | |
|---|---|---|
| GB | 1 524 149 A | 9/1978 |

* cited by examiner

*Primary Examiner*—Derris H. Banks
*Assistant Examiner*—Teresa M. Bonk
(74) *Attorney, Agent, or Firm*—Brij K. Agarwal; Eckert Seamans Cherin & Mellott, LLC

(57) ABSTRACT

An improved machine for performing a swaging operation includes a mandrel and an expandable collet that are mounted to an actuator such as a conventional pneumatic gun. The mandrel includes a plurality of ramped planar engagement surfaces that are slidably engageable with a plurality of planar reaction surfaces on deflectable segments of the collet. The planar nature of the engagement surfaces and the reaction surfaces avoids unwanted deflection of the segments that would otherwise turn the segments into cutting tools, such as would occur if the surfaces were of certain other shapes. The mandrel is rotatably mounted to the pneumatic gun whereby the engagement surfaces are self-aligning with the reaction surfaces during an initial stage of a swaging operation.

23 Claims, 5 Drawing Sheets

NON-IMPACT SWAGING APPARATUS

FIELD OF THE INVENTION

The present invention relates generally to swaging machinery and, more particularly, to a non-impact swaging apparatus.

BACKGROUND OF THE INVENTION

Swaging operations are employed in numerous different processes, typically assembly processes. Broadly stated, a swaging operation typically involves the plastic deformation of a first component into engagement with a second component to connect the first and second components together.

A swaging operation is employed, for example, in the aerospace industry to fasten a threaded insert into a hole formed in a larger structure such as a casting. Certain large aerospace structures such as castings can be extremely expensive and cost one million dollars or more. Many such expensive structures are employed in applications that require periodic disassembly, such as for maintenance, inspection, and the like. Threaded fasteners employed with such structures often include one or more known self-locking features such as are provided with special coatings or platings on the threads and special thread configurations. The repeated threading and unthreading of such threaded fasteners onto and off of a larger structure has a tendency to cause wear to the threads, particularly if the fasteners include a self-locking feature.

It is thus known to provide threaded inserts for use in conjunction with such larger structures such as castings. These inserts are hollow cylindrical members having thin walls that are threaded both internally and externally, with a counterbore being formed at one end of the insert. Such inserts are threadably received in a threaded and counterbored hole formed in the larger structure. The counterbored region of the insert is swaged radially outwardly into fastening engagement with the counterbored region of the larger structure to affix the insert into the hole formed in the structure. A threaded fastener can then be threadably received in the internal threads of the installed insert.

Such threaded inserts often are formed out of relatively hard materials such as titanium and nickel based alloys. These alloys are relatively harder than the larger structures which often are made of a relatively softer material such as aluminum. The internal threading of the insert often includes a self-locking feature such as the aforementioned coating or plating on the threads or the special thread configuration, and such internal threading typically is guaranteed to last a certain number of threading and unthreading cycles, such as fifteen cycles. Once an installed insert has undergone the guaranteed number of cycles, i.e., has had a threaded fastener threaded into and unthreaded from the internal threads the guaranteed number of times, the insert is removed in a known fashion from the relatively larger structure and is replaced with a new insert of the same configuration. The new insert would then again provide a given number of threading and unthreading cycles before it too would need to be replaced.

Since the insert is swaged to the relatively larger structure instead of employing a self-locking feature between it and the relatively larger structure, the repeated replacement of the threaded inserts does not raise an issue of thread wear as to the relatively larger structure itself. The swaging of such threaded inserts has not, however, been without limitation. Threaded inserts typically have been swaged to the relatively larger structure by hammering. Such hammering is imprecise and raises a substantial risk of damaging the relatively larger structure which, as set forth above, can be extremely expensive. Such hammering can also be extremely difficult to perform in the cramped confines of many aerospace applications.

Alternative swaging operations have met with little success. One such type of alternate swaging operation involved threadably mounting a swaging tool to the internal threading of an insert and applying forces in a threading direction to plastically deform the counterbored portion of the insert into swaged engagement with the counterbored portion of the relatively larger structure. Such systems can damage the coating or plating on the internal threads and thus interfere with and reduce the number of threading and unthreading cycles the insert can withstand. Additionally, some inserts include radially outwardly protruding structures on the external surface thereof in the region of the counterbore, and during the swaging operation the protruding structures are received in pre-broached holes formed in the counterbore of the relatively larger structure. Prior to the swaging operation the protruding structures must be rotationally aligned with the pre-broached holes. Such rotational alignment is difficult to maintain if a swaging operation requires the threadable cooperation of a swaging tool with the internal threads on an insert.

It is thus desired to provide an improved machine that can perform a non-impact swaging operation on first component, such as a threaded insert, to swage it and a second component together. Such an improved machine preferably would not rely upon threadable cooperation with the internal threads of an insert and would not have a tendency to disturb rotational alignment between protruding structures on a threaded insert and corresponding pre-broached holes formed on the second component, which may be a relatively larger structure. The machine would desirably also be made up of tooling that is mounted to a known actuator, such as a pneumatic gun of the type already employed for various purposes in aerospace applications.

SUMMARY OF THE INVENTION

An improved machine in accordance with the present invention meets and exceeds these and other needs. An improved machine for performing a swaging operation includes a mandrel and an expandable collet that are mounted to a conventional pneumatic gun. The mandrel includes a plurality of ramped planar engagement surfaces that are slidably engageable with a plurality of planar reaction surfaces on deflectable segments of the collet. The planar nature of the engagement surfaces and the reaction surfaces avoids unwanted deflection of the segments that would otherwise turn the segments into cutting tools, such as would occur if the surfaces were of certain other shapes. The mandrel is rotatably mounted to the pneumatic gun whereby the engagement surfaces are self-aligning with the reaction surfaces during an initial stage of a swaging operation.

An aspect of the present invention is to provide an improved machine for performing a non-impact swaging operation.

Another aspect of the present invention is to provide an improved machine that performs a swaging operation without relying upon threaded cooperation with the structure being swaged.

Another aspect of the present invention is to provide an improved machine for performing a swaging operation with the machine including a pivotable mandrel and a collet having a plurality of expandable segments.

Another aspect of the present invention is to provide an improved machine for performing a swaging operation in which a plurality of planar engagement surfaces on a mandrel are slidably engageable with a plurality of planar reaction surfaces on deflectable segments of an expandable collet.

Another aspect of the present invention is to provide an improved machine for performing a swaging operation with the machine including a swaging apparatus that is mounted to a conventional actuator, such as a known pneumatic gun.

Another aspect of the present invention is to provide a swaging apparatus for use with a known actuator, such as a pneumatic gun, to provide an improved machine for performing a swaging operation.

Another aspect of the present invention is to provide an improved method of swaging wherein sliding engagement of generally planar surfaces of a mandrel with generally planar surfaces of a collet is established through self-alignment of the surfaces of the mandrel with the surfaces of the collet.

These and other aspects of the present invention are provided by an improved swaging apparatus that is structured to be operatively mounted to an actuator, and with the swaging apparatus being structured to swage together a first member and a second member, in which the general nature of the swaging apparatus can be stated as including a support, a mandrel, and a collar. The support is structured to be disposed on the actuator. The mandrel includes a plurality of substantially planar engagement surfaces. The collet is structured to be disposed on the actuator and includes a base and a plurality of segments. The segments are disposed on the base and are elastically deflectable with respect to the base. Each segment includes a substantially planar reaction surface and an arcuate swaging surface. The engagement surfaces are slidably engageable with the reaction surfaces to deflect the segments between a collapsed position and an extended position, with the segments in the extended position being structured to swagingly engage the first member. The mandrel is rotatably disposed on the support whereby the engagement surfaces are self-alignable with the reaction surfaces, with the engagement surfaces being disposed on the mandrel generally opposite the support.

Other aspects of the present invention are provided by an improved machine for swaging together a first member and a second member, in which the general nature of the machine can be stated as including an actuator and a swaging apparatus. The actuator includes a housing and a translatable piston. The swaging apparatus is operatively mounted to the actuator. The swaging apparatus includes a support, a mandrel, and a collet. The support is disposed on one of the housing and the piston. The collet is disposed on the other of the housing and the piston. The collet includes a base and a plurality of segments, with the segments being disposed on the base and being elastically deflectable with respect to the base. Each segment includes a substantially planar reaction surface and an arcuate swaging surface. The mandrel includes a plurality of substantially planar engagement surfaces. The engagement surfaces are slidably engageable with the reaction surfaces to deflect the segments between a collapsed position and an extended position, the segments in the extended position being structured to swagingly engage the first member. The mandrel is rotatably disposed on the support whereby the engagement surfaces are self-alignable with the reaction surfaces, with the engagement surfaces being disposed on the mandrel generally opposite the support.

Other aspects of the present invention are provided by an improved method of swaging together a first member and a second member, in which the general nature of the method can be stated as including providing a mandrel having a plurality of substantially planar engagement surfaces, providing a collet having a plurality of deflectable segments, each segment having a substantially planar reaction surface and an arcuate swaging surface, establishing slidable engagement of the engagement surfaces with the reaction surfaces through self-alignment to elastically deflect the segments between a collapsed position and an extended position, and swagingly engaging the swaging surfaces with the first member.

Other aspects of the invention are provided by an improved machine for swaging together a first member and a second member. The general nature of the machine can be stated as including an actuator having a housing and a translatable piston, and a swaging apparatus operatively mounted to the actuator. The swaging apparatus includes a support, a mandrel, and a collet. The support is disposed on one of the housing and the piston, and the collet is disposed on the other of the housing and the piston. The collet is rotatably adjustable among a plurality of rotational positions with respect to the other of the housing and the piston. The collet includes a base and a plurality of segments, with the segments being disposed on the base and being elastically deflectable with respect to the base. Each segment includes a substantially planar reaction surface and a swaging surface. The mandrel includes a plurality of substantially planar engagement surfaces. The engagement surfaces are slidably engageable with the reaction surfaces to deflect the segments between a collapsed position and an extended position, the segments in the extended position being structured to swagingly engage the first member. The mandrel is rotatably disposed on the support and self-alignable with the reaction surfaces according to the rotational position of the collet with respect to the other of the housing and the piston.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DETAILED DESCRIPTION OF PREFERRED EMBODIMENT

Figure 1:
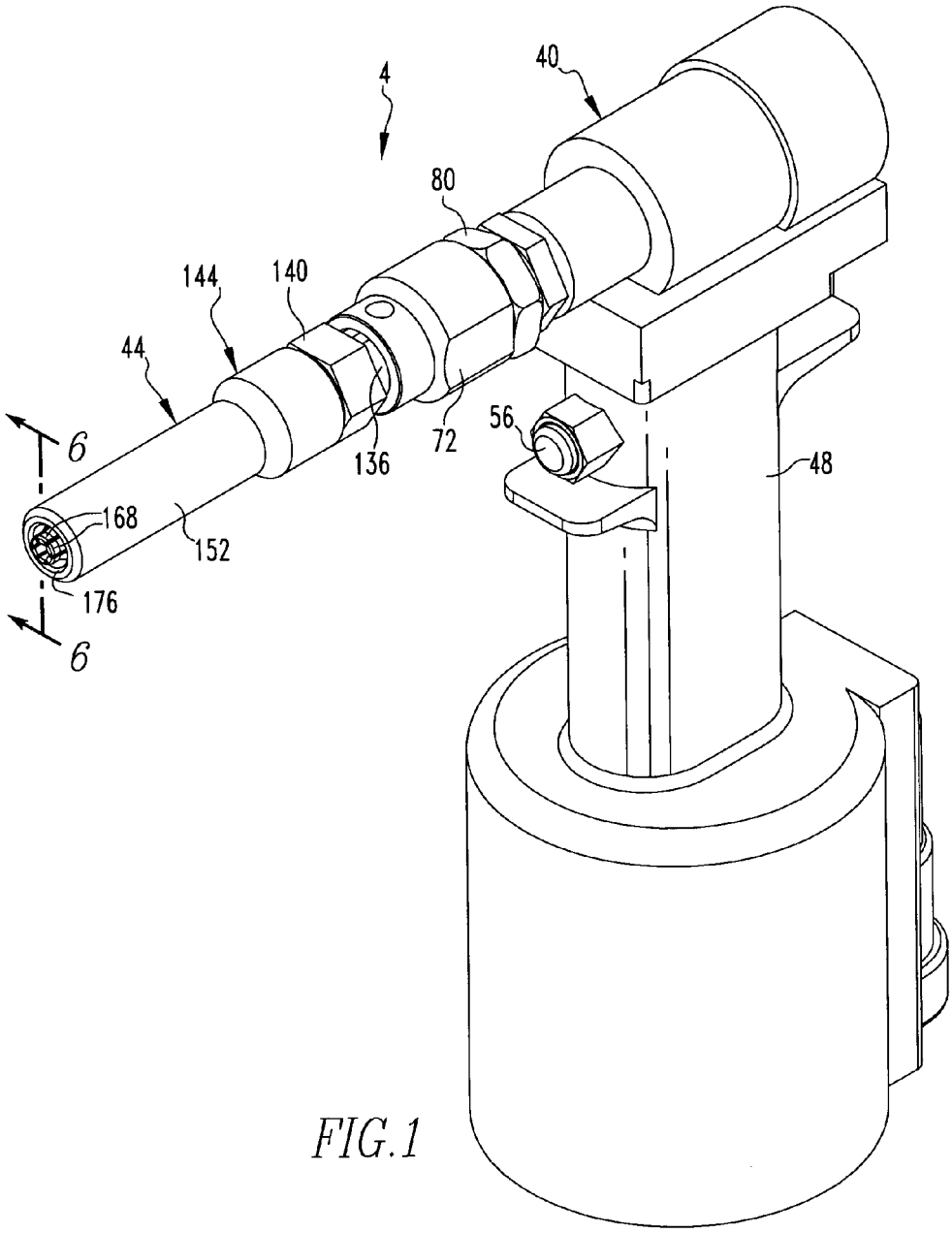
FIG. 1 is a perspective view of an improved machine in accordance with the present invention.
Figure 2:
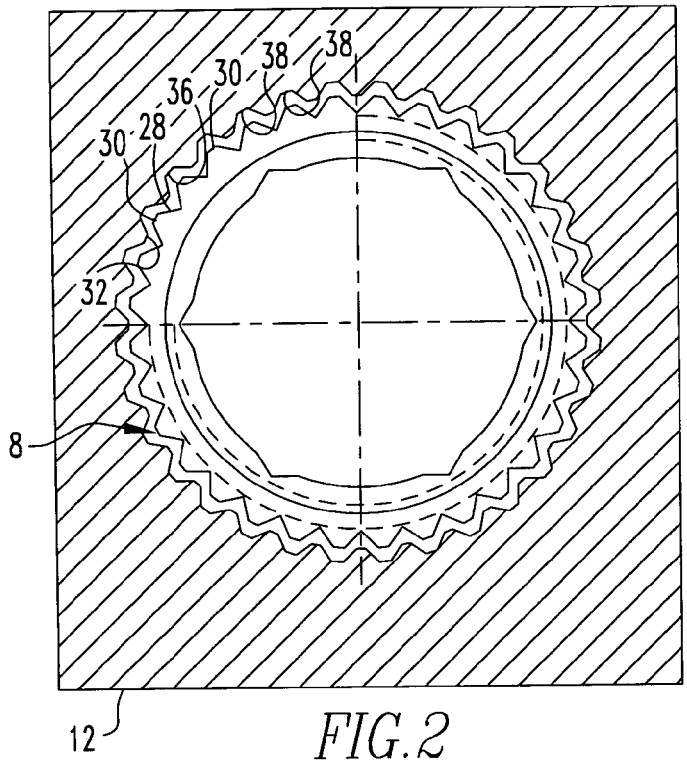
FIG. 2 is an end view of a threaded insert disposed on another structure prior to the performance of a swaging operation.
Figure 3:
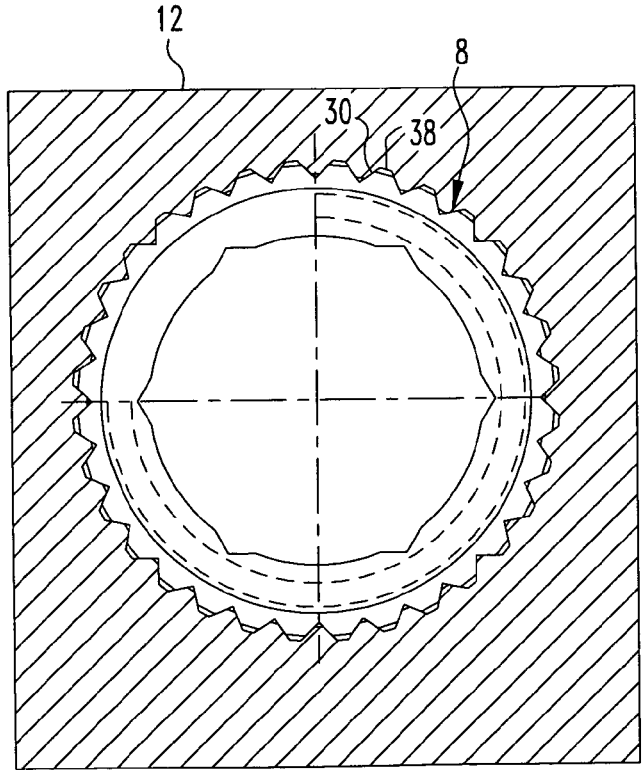
FIG. 3 is a view similar to FIG. 2, except depicting the threaded insert subsequent to the performance of a swaging operation.
Figure 4:
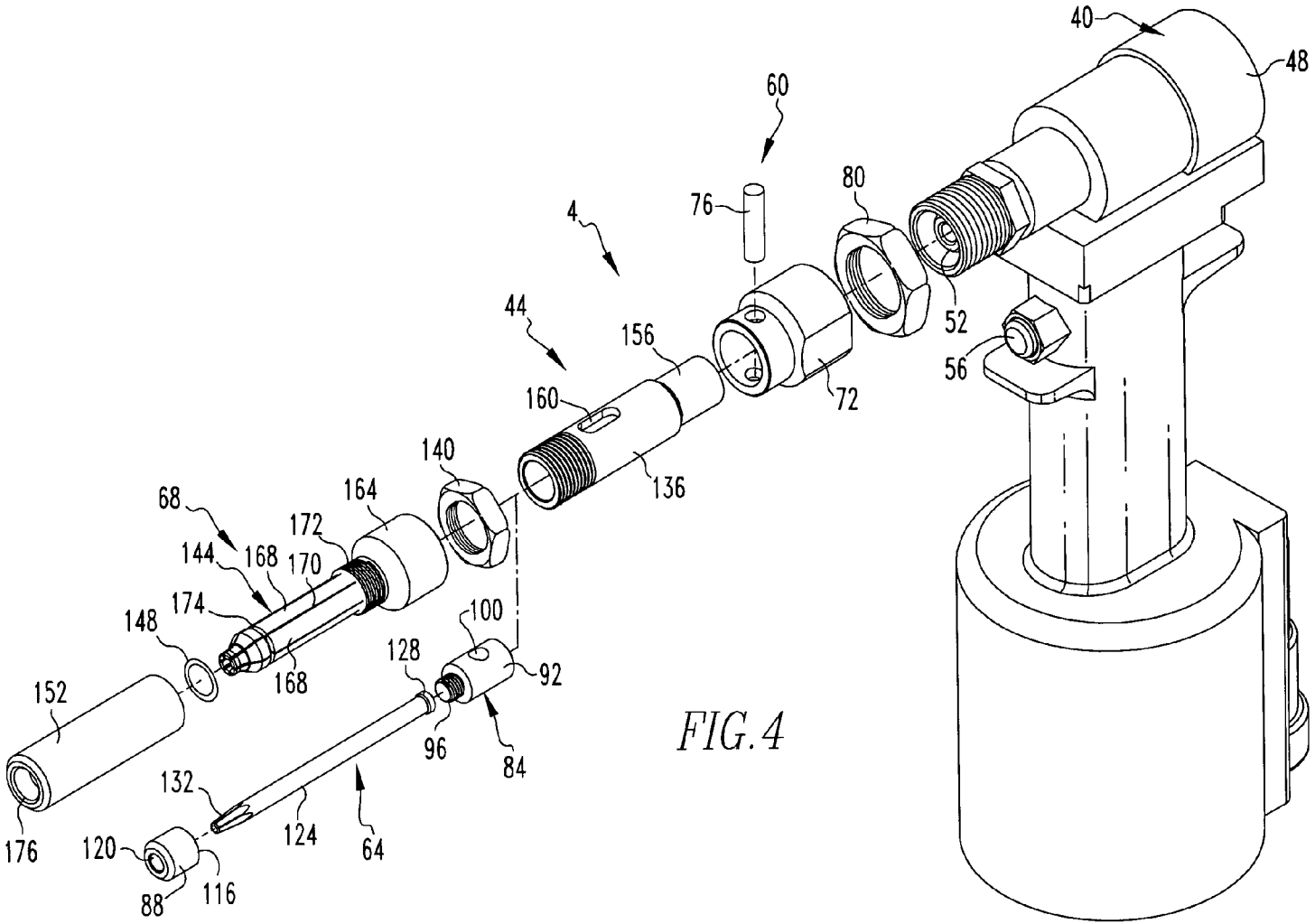
FIG. 4 is an exploded perspective view of the machine of FIG. 1.

An improved machine 4 in accordance with the present invention is indicated generally in FIGS. 1 and 4. The improved machine 4 can be advantageously employed to perform a non-impact swaging operation on a first component such as a threaded insert 8 (FIGS. 2, 3, and 5) to fasten the first component to a second component, such as a relatively larger structure 12 (FIGS. 2 and 3.) The machine 4, in the depicted embodiment, is a compact, substantially movable handheld device which advantageously can be used in numerous locations, such as within the cramped confines of aerospace applications. While the machine 4 and the corresponding method are described herein as being employed in conjunction with the threaded insert 8, it is understood that the machine 4 and various other configurations thereof could be employed in other swaging operations without departing from the concept of the present invention.

Figure 5:
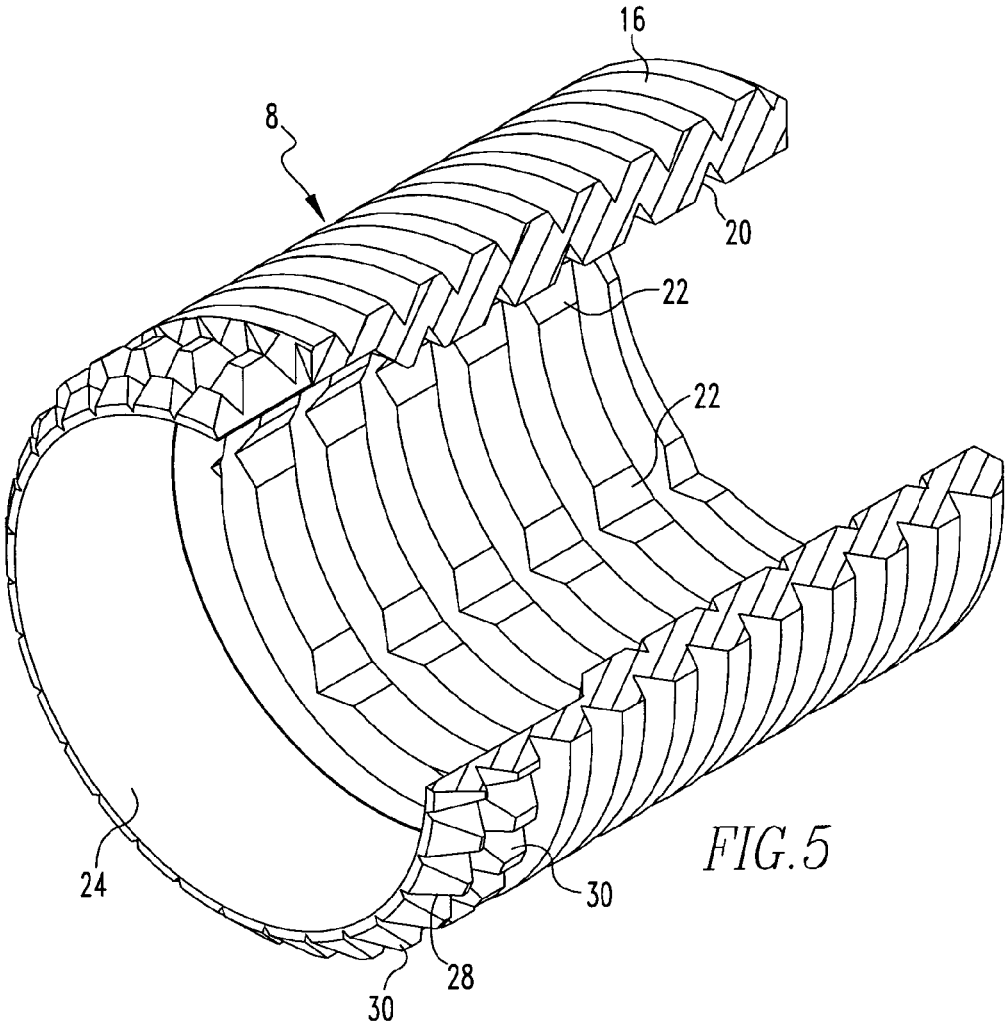
FIG. 5 is a perspective view of the threaded fastener of FIG. 2 prior to the performance of a swaging operation.

As can be understood from FIGS. 2, 3, and 5, the insert 8 is a hollow cylindrical member having external threading 16 (FIG. 5) on an external surface thereof and internal threading 20 having longitudinal cuts 22 on an internal surface thereof. The cuts 22 are cooperable with an appropriate implement (not shown) when the insert 8 is being threaded into a hole formed in the relatively larger structure 12. The insert 8 additionally includes a counterbore 24 at one end thereof and external knurling 28 formed on the external threading 16 in the vicinity of the counterbore 24. The external knurling 28 on the external threading 16 forms a plurality of radially outwardly extending projections 30.

The structure 12 includes a bore 32 that is counterbored and internally threaded. The bore 32 includes internal knurling 36 in the counterbore region that forms a plurality of pre-broached receptacles 38.

As will be described in further detail below, the insert 8 is swaged to the structure 12 by first threadably receiving the insert 8 into the bore 32. The insert 8 is rotationally positioned such that the projections 30 are rotationally aligned with the pre-broached receptacles 38, such as is shown generally in FIG. 2. A radial force is then applied by the machine 4 to the counterbore 24 of the insert 8 which plastically deforms the counterbored region of the insert 8 into swaged engagement with the structure 12 such that the projections 30 are received in the pre-broached receptacles 38.

The improved machine 4 includes an actuator 40 and swaging apparatus 44. The actuator 40 can be any of a wide variety of known actuation devices such as a known pneumatic gun of the type already employed in the aerospace industry for various purposes. The swaging apparatus 44 can be generally described as tooling that is mounted to the actuator 40 to form the machine 4 and to enable the performance of swaging operations.

The actuator 40 can be generally described as including a housing 48, a piston 52, and a trigger 56. The piston 52 is movably mounted to the housing 48 and is selectively translated when the trigger 56 is pressed. The trigger 56 is also mounted to the housing 48. In the example shown herein, the piston 52 is translatable longitudinally between a non-energized position, which is the condition of the machine 4 shown generally in FIGS. 1 and 6, and an energized position when the trigger 56 is pressed, such as in the depiction of the machine 4 in FIG. 7.

As can be seen in FIG. 4, the swaging apparatus 44 can be generally described as including a support 60, a mandrel 64 and an expendable collet 68. In the example depicted herein, the support 60 and the mandrel 64 are disposed on the housing, and the collet 68 is disposed on the piston 52. Other arrangements of the swaging apparatus 44 are possible in which different portions thereof are mounted to the housing 48 and to the piston 52.

The support 60 includes a mounting member 72, a pin 76, a first locknut 80, a retention block 84, and a collar 88. The mounting member 72 is threadably mounted to a threaded end of the housing 48, and the first locknut 80 is threaded into engagement with the mounting member 72 to lock the mounting member 72 in a given position on the housing 48.

The retention block 84 includes a pedestal 92 and a post 96. The pedestal 92 includes a thru-bore 100 extending transversely therethrough and includes a ledge 104 adjacent the post 96. The pin 76 is received through the thru-bore 100 and through a pair of opposed holes formed in the mounting member 72 to connect together the retention block 84 and the mounting member 72. The pin 76 can be retained in such position by any of a known variety of methods and structures, such as through clips and the like or through press fitting of the pin 76, as well as by other methods and structures.

The post 96 includes a substantially planar mounting surface 108 opposite the ledge 104 and a threaded lateral surface 112 adjacent the ledge 104. The collar 88 is internally threaded and includes an annular end surface 116 and a substantially circular opening 120 at opposite ends thereof. The internal threading on the collar 88 is threadably cooperable with the external threading on the lateral surface 112 of the post 96 to mount the mandrel 64 to the retention block 84 and thus to the support 60.

More specifically, the mandrel 64 includes an elongated shaft 124 and a flared head 128. The shaft 124 includes a plurality of substantially planar engagement surfaces 132 that are circumferencially spaced about the shaft 124 and are oriented at an angle with respect to the longitudinal extent of the shaft 124. Portions of the shaft 124 in the vicinity of the engagement surfaces 132 have a cross section in the shape of a regular polygon, such as a hexagon, octagon, and the like, and in other regions the shaft 124 has a circular cross section.

The collar 88 rotatably mounts the mandrel 64 onto the retention block 84. More specifically, the head 128 is received against the mounting surface 108, the shaft 124 is received through the opening 120 in the collar 88, and the internal threading on the collar 88 is threaded onto the external threading of the lateral surface 112 of the post 96 until the end surface 116 of the collar 88 engages the ledge 104 of the pedestal 92. When the collar 88 is attached as such to the retention block 84, a small amount of space exists between the head 128 and the collar 88 such that the mandrel 64 is rotatable with respect to the retention block 84, the retention block 84 being generally non-rotatably mounted to the mounting member 72 with the pin 76. As will be described in greater detail below, such rotatable mounting of the mandrel 64 onto the support 60 advantageously permits and facilitates self-alignment of the engagement surfaces 132 with corresponding surfaces on the collet 68 during an initial part of a swaging operation.

The collet 68 includes a connector 136, a second locknut 140, a tool 144, a biasing member 148, and a spacer 152. The connector 136 includes a nipple 156 at one end thereof that is internally threaded and that is threaded onto cooperative external threading on the piston 52. The connector 136 additionally includes external threading formed thereon at the end opposite the nipple 156. A pair of opposed slots 160, only one of which is shown in FIG. 4, are formed in the connector 136. In receiving the pin 76 through the thru-bore 100 of the retention block 84, the pin 76 is additionally received through the slots 160, whereby the retention block 84 is disposed generally within an interior of the connector 136.

In the exemplary embodiment depicted herein, the tool 144 is a monolithically formed single piece member and includes a base 164 and a plurality of segments 168 that are defined by slots 170 formed in the tool 144. The base 164 additionally includes an externally threaded region 172.

The segments 168 together have an annular notch 174 formed therein at a location generally opposite the base 164, and the biasing member 148 is received in the notch 174. In the exemplary embodiment depicted, the biasing member 148 is an elastic band formed out of a resilient material. The biasing member 148 biases the segments 168 toward a collapsed position (FIG. 6) in which, in the depicted embodiment, the segments 168 engage one another and generally close the slots 160 therebetween.

The spacer 152 is a hollow cylindrical member that is formed out of a rigid material, such as metal. The spacer 152 includes an annular positioning surface 176 at one end thereof. Opposite the positioning surface 176 the spacer 152 is internally threaded and is threadably cooperable with the threaded region 172 of the base 164 to threadably mount the spacer 152 to the base 164. In such condition, the segments 168 extend generally throughout the interior of the spacer 12 and protrude outwardly from the positioning surface 176.

The base 164 additionally includes an internally threaded portion that is threaded, along with the second locknut 144 onto to the threaded portion of the connector 136. The second locknut 140 is rotated into engagement with the base 164 to retain the tool 144 in a given desired position on the connector 136.

At the free ends of the segments 168, i.e., generally opposite the base 164, each segment 168 includes a substantially planar reaction surface 180 (FIGS. 6 and 7) and an opposite arcuate swaging surface 184.

When the machine 4 is in a non-energized condition (FIG. 6) the mandrel 64 is in a first position with respect to the reaction surfaces 180. In the exemplary embodiment depicted herein, the engagement surfaces 132 of the mandrel 64 are disengaged from and out of contact with the reaction surfaces 180 of the segments 168. When the machine 4 is energized, however, such as by depressing the trigger 56, the piston 52 translates within the housing 48 and pulls the collet 68 generally toward the housing 48 while the mandrel 64 does not translate. Such movement of the collet 68 causes the mandrel 64 to be disposed in a second position (FIG. 7) with respect to the segments 168. In such condition, the engagement surfaces 132 are slidably engaged with the reaction surfaces 180.

Figure 7:
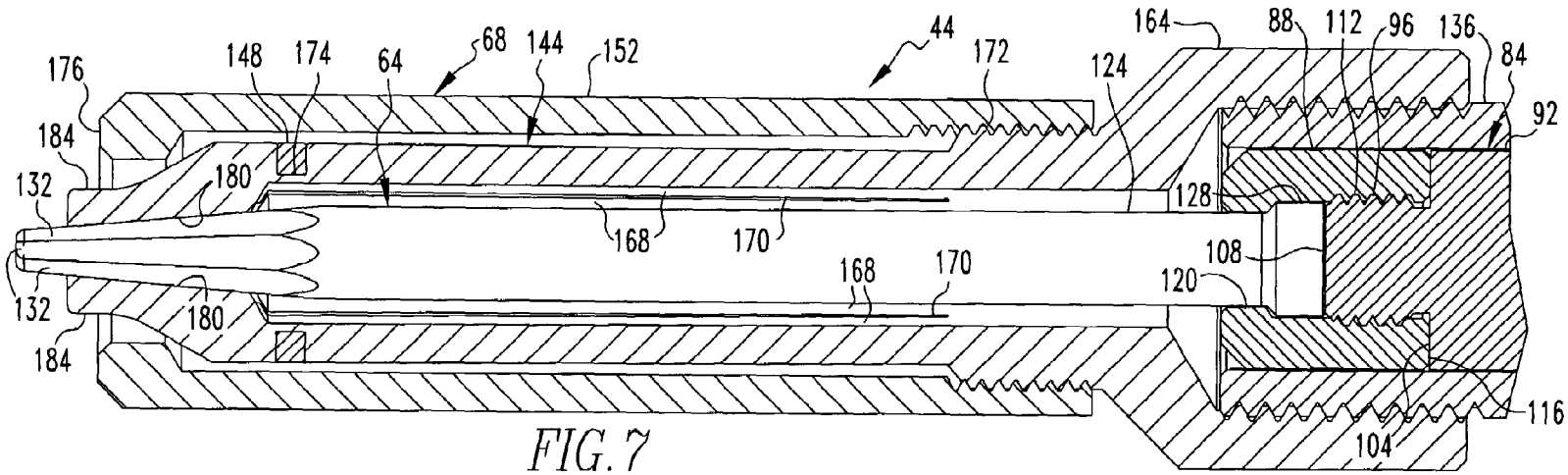
FIG. 7 is a view similar to FIG. 6, except depicting the swaging apparatus in a different condition.

Since the engagement surfaces 132 are angled with respect to the longitudinal extent of the shaft 124, such translation of the collet 68 with respect to the mandrel 64 and the corresponding sliding engagement of the engagement surfaces 132 with the reaction surfaces 180 causes the segments 168 to be elastically deflected to an extended position, as is shown generally in FIG. 7. When the segments 168 are in the extended position, the swaging surfaces 184 are all aligned on an imaginary circle, and more specifically are aligned on an imaginary cylinder. When in the collapsed position the swaging surfaces 184, in the exemplary embodiment, are positioned in a generally conic shape. In the exemplary embodiment depicted herein, the segments 168 in their free state, i.e., in the absence of the biasing member 148, are disposed in the extended position, and the biasing member biases the segments 168 toward the collapsed position. Engagement of the engagement surfaces 132 with the reaction surfaces 180 overcomes the bias of the biasing member 148 and deflects the segments 168 to the extended position.

Since the engagement surfaces 132 and the reaction surfaces 180 are all substantially planar, the engagement surfaces 132 and the reaction surfaces 180 are in slidable planar engagement with one another throughout the entire advancement of the mandrel 64 with respect to the segments 168 between the first and second positions. Such planar engagement generally resists deflection of the segments 168 and the swaging surfaces 184 about axes generally parallel with the longitudinal extent of the shaft 124, in which situation the segments 168 would otherwise undesirably become cutting tools. The planar engagement of the engagement surfaces 132 and the reaction surfaces 180 generally results only in radially outward deflection of the swaging surfaces 184 to the extended position in which the swaging surfaces 184 together lie on the imaginary circle. This helps to avoid cutting of the counterbore 124 of the insert 8 during a swaging operation.

Figure 6:
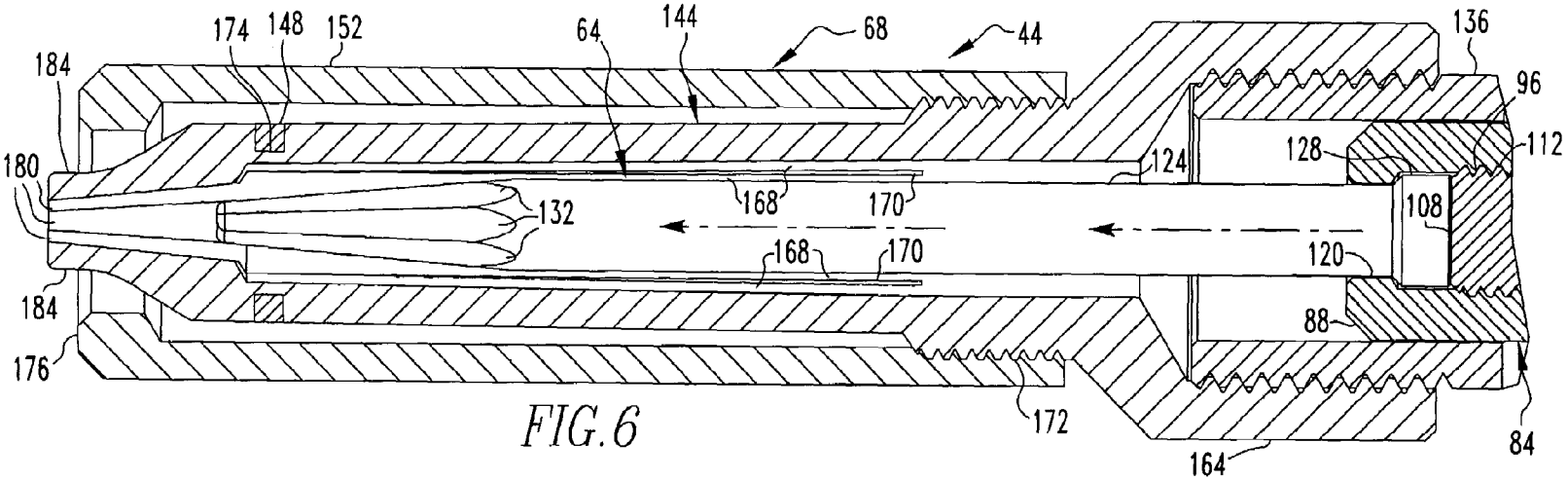
FIG. 6 is a sectional view as taken along line 6—6 of FIG. 1.

As explained above, the engagement surfaces 132 are disengaged from and out of contact with the reaction surfaces 180 when the swaging apparatus 4 is in the first position (FIG. 6). When the machine 4 is energized and the swaging apparatus 44 is moved toward the second position (FIG. 7) the engagement surfaces 132 are in need of being aligned with the reaction surfaces 180 in order to provide planar engagement between the engagement surfaces 132 and the reaction surfaces 180. The pivotable mounting of the mandrel 64 onto the retention block 84 permits the engagement surfaces 132 to self-align with the reaction surfaces 180 during an initial part of a swaging operation, i.e., when the engagement surfaces 132 first contact the reaction surfaces 180. For instance, if the mandrel 64 is rotated slightly with respect to the tool 144 prior to initiation of the swaging operation, such that the engagement surfaces 132 are slightly rotationally misaligned with the reaction surfaces 180, once the swaging operation is initiated and the engagement surfaces 132 first contact the reaction surfaces 180, the ramped nature of the engagement surfaces 132 and the reaction surfaces 180 will cause the mandrel 64 to rotate slightly until the engagement surfaces 132 and the reaction surfaces 180 are in planar engagement with one another. The energy from translation of the piston 52 provides the effort needed to rotate the mandrel 64.

Such automatic rotational alignment of the mandrel 64 is highly advantageous since it permits the swaging apparatus 44 to be manufactured less expensively than if the mandrel 64 and the collet 68 were designed to always be in rotational alignment with one another. Such constant rotational alignment would necessitate additional measures such as additional slots and grooves and the like that are costly to form within close tolerances. By providing the free rotatability of the mandrel 64 with respect to the segments 168, the mandrel 64 advantageously self-aligns with the segments 168 during the initial part of the swaging operation when the engagement surfaces 132 first contact the reaction surfaces 180.

In order to perform a swaging operation, the positioning surface 176 of the spacer 152 is received against either the insert 8 or the structure 12 to position the segments 168, and more specifically the swaging surfaces 184, with respect to the counterbore 24 of the insert 8. Upon the energizing the machine 4 by depressing the trigger 56, the piston 52 translates with respect to the housing 58 which moves the collet 68 with respect to the mandrel 64 from the position shown generally in FIG. 6 to the position shown generally in FIG. 7, and the segments 168 are elastically deflected by the mandrel 64 from the collapsed position to the extended position. In so doing, the engagement surfaces 132 became self-aligned with the reaction surfaces 180 due to the pivotable mounting of the mandrel 64 on the retention block 84. While the segments 168 are described herein as being elastically deflected by the mandrel 64 from the collapsed position to the extended position, it is noted that such terminology can refer alternatively or additionally to elastic deflection of the biasing member 148, depending upon whether the segment 168 in their free state are in the extended position, the collapsed position, or a position therebetween.

The expansion of the swaging surfaces 184 from the collapsed position to the extended position plastically deforms the counterbore 24 from its original position (FIGS. 2 and 5) to a swaged position (FIG. 3). Prior to performing the swaging operation, the projections 30 of the insert 8 were rotationally aligned with the pre-broached receptacles 38 of the structure 12 (FIG. 3), and after the swaging operation the projections 30 are received in the pre-broached receptacles 38.

When the trigger 56 is released the piston 52 translates back to its original position, thereby translating the collet 68 so as to remove the mandrel 64 from the reaction surfaces 180 and to permit the segments 168 to return to the collapsed position. The machine 4 can then be removed from the insert 8.

It is noted that when the protruding portions of the segments 168 are received within the counterbore 24 prior to the machine 4 being energized, a relatively small clearance exists between the swaging surfaces 184 and the counterbore 24. When the machine 4 is energized, the translation of the collet 68 with respect to the mandrel 64 is substantially greater than the radial travel of the reaction surfaces 180. As such, the swaging motion of the reaction surfaces 180 is relatively small but is sufficient to plastically deform the counterbore 24 and swage the insert 8 into the bore 32 of the structure 12.

The spacer 152 is positioned on the threaded region 172 to permit the segments 168 to protrude a specific depth into the counterbore 24 of the insert 8. In some applications, the structure 12 may be configured to not include the internal knurling 36 or the pre-broached receptacles 38, with the insert still including the projections 30, and in such applications the projections 30 may be swaged directly into the material of the structure 12. In such applications, the spacer 152 may be of a different configuration or may be adjusted to a specific position on the threaded region 172 to permit an appropriate depth of penetration of the segments 168 into the counterbore 24 depending upon the swaging characteristics desired.

It is noted that the tool 144 is threaded to a specific threaded position on the connector 136 according to the swaging characteristics desired for the specific application, and the tool 144 is locked in place with the second locknut 140. Depending upon the swaging forces and/or other characteristics desired during swaging, the tool 144 may be threaded on the connecter 136 to a slightly different position and locked in place with the second locknut 140. Such threaded position of the tool 144 on the connector 136 affects the interaction between the engagement surfaces 132 and the reaction surfaces 180, which can affect the forces and other characteristics at the swaging surfaces 184 upon operation of the machine 4, particularly because the piston 52 and thus the mandrel 64 have only a limited longitudinal travel.

The rotatable mounting of the mandrel 64 on the retention block 84 thus advantageously cooperates with the threaded/rotational adjustability of the tool 144 with respect to the connector 136 to permit proper operation of the machine 4 at substantially any force setting thereof. In the depicted embodiment the tool 144 is continuously threadably adjustable on the connector 136, and the rotatable mounting of the mandrel 64 on the retention block 84 facilitates proper cooperation between the mandrel 64 and the tool 144 regardless of the rotational/force setting of the tool 144.

The engagement surfaces 132 are oriented with respect to the longitudinal extent of the shaft 124 at an angle that is selected to substantially multiply the force of the piston 52 on the swaging apparatus 44 substantially without creating frictional problems in withdrawing the mandrel 64 from the segments 168. In the exemplary embodiment the engagement surfaces 132 are oriented at an angle of about 5° with respect to the longitudinal extent of the shaft 124, although other angles may be appropriate depending upon the desired characteristics of the swaging apparatus 44. The exemplary swaging apparatus 44, and the resultant machine 4, advantageously operate in a smooth continuous process that is substantially free of impact or shock on the insert 8 and/or the structure 12.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A swaging apparatus structured to be operatively mounted to an actuator, the swaging apparatus being structured to swage together a first member and a second member, the swaging apparatus comprising:

a support structured to be disposed on the actuator;

a mandrel including a plurality of substantially planar engagement surfaces;

a collet structured to be disposed on the actuator;

the collet including a base and a plurality of segments, the segments being disposed on the base and being elastically deflectable with respect to the base;

each segment including a substantially planar reaction surface and an arcuate swaging surface;

the engagement surfaces being slidably engageable with the reaction surfaces to deflect the segments between a collapsed position and an extended position, the segments in the extended position being structured to swagingly engage the first member; and the mandrel being rotatably disposed on the support, whereby the engagement surfaces are self-alignable with the reaction surfaces, the engagement surfaces being disposed on the mandrel generally opposite the support.

2. The swaging apparatus of claim 1, wherein the segments are biased toward the collapsed position.

3. The swaging apparatus of claim 2, wherein the collet includes a biasing member that biases the segments toward the collapsed position.

4. The swaging apparatus of claim 1, wherein
the collet includes a hollow spacer having a positioning surface;
the spacer being disposed on the base;
the segments extending through at least a portion of the spacer and protruding outwardly from the positioning surface; and
the positioning surface being structured to be receivable against one of the first and second members to position the segments with respect to the first member.

5. The swaging apparatus of claim 1, wherein
the mandrel includes a head;
the support including a collar;
at least a portion of the mandrel extending through the collar; and
the collar retaining the head rotatably mounted to the support.

6. The swaging apparatus of claim 1, wherein
at least a portion of the mandrel in the vicinity of the engagement surfaces has a cross sectional shape substantially of a regular polygon.

7. The swaging apparatus of claim 1, wherein
the swaging surfaces extend along an imaginary circle when the segments are in the extended position.

8. The swaging apparatus of claim 1, wherein
one of the mandrel and the collet is movable with respect to the other of the mandrel and the collet between a first position and a second position, the engagement surfaces being disengaged from the reaction surfaces and the segments being in the collapsed position when the one of the mandrel and the collet is in the first position, the engagement surfaces being engaged with the reaction surfaces and the segments being in the extended position when the one of the mandrel and the collet is in the second position.

9. A machine for swaging together a first member and a second member, the machine comprising:
an actuator including a housing and a translatable piston;
a swaging apparatus operatively mounted to the actuator;
the swaging apparatus including a support, a mandrel, and a collet;
the support being disposed on one of the housing and the piston;
the collet being disposed on the other of the housing and the piston;
the collet including a base and a plurality of segments, the segments being disposed on the base and being elastically deflectable with respect to the base;
each segment including a substantially planar reaction surface and an arcuate swaging surface;
the mandrel including a plurality of substantially planar engagement surfaces;
the engagement surfaces being slidably engageable with the reaction surfaces to deflect the segments between a collapsed position and an extended position, the segments in the extended position being structured to swagingly engage the first member; and
the mandrel being rotatably disposed on the support, whereby the engagement surfaces are self-alignable with the reaction surfaces, the engagement surfaces being disposed on the mandrel generally opposite the support.

10. The machine of claim 9, wherein
the segments are biased toward the collapsed position.

11. The machine of claim 10, wherein
the collet includes a biasing member that biases the segments toward the collapsed position.

12. The machine of claim 9, wherein
the collet includes a hollow spacer having a positioning surface;
the spacer being disposed on the base;
the segments extending through at least a portion of the spacer and protruding outwardly from the positioning surface;
the positioning surface being structured to be receivable against one of the first and second members to position the segments with respect to the first member.

13. The machine of claim 9, wherein
the mandrel includes a head;
the support including a collar;
at least a portion of the mandrel extending through the collar; and
the collar retaining the head rotatably mounted to the support.

14. The machine of claim 9, wherein
at least a portion of the mandrel in the vicinity of the engagement surfaces has a cross sectional shape substantially of a regular polygon.

15. The machine of claim 9, wherein
the swaging surfaces extend along an imaginary circle when the segments are in the extended position.

16. The machine of claim 9, wherein
one of the mandrel and the collet is movable with respect to the other of the mandrel and the collet between a first position and a second position, the engagement surfaces being disengaged from the reaction surfaces and the segments being in the collapsed position when the one of the mandrel and the collet is in the first position, the engagement surfaces being engaged with the reaction surfaces and the segments being in the extended position when the one of the mandrel and the collet is in the second position.

17. A method of swaging together a first member and a second member, the method comprising:
providing a mandrel having a plurality of substantially planar engagement surfaces;
providing a collet having a plurality of deflectable segments, each segment having a substantially planar reaction surface and an arcuate swaging surface;
establishing slidable engagement of the engagement surfaces with the reaction surfaces through self-alignment to elastically deflect the segments between a collapsed position and an extended position; and
swagingly engaging the swaging surfaces with the first member.

18. The method of claim 17 wherein
self-alignment is permitted through rotation of one of the mandrel and the collet with respect to the other.

19. A machine for swaging together a first member and a second member, the machine comprising:
an actuator including a housing and a translatable piston;
a swaging apparatus operatively mounted to the actuator;
the swaging apparatus including a support, a mandrel, and a collet;
the support being disposed on one of the housing and the piston;
the collet being disposed on the other of the housing and the piston, the collet being rotatably adjustable among a plurality of rotational positions with respect to the other of the housing and the piston;

the collet including a base and a plurality of segments, the segments being disposed on the base and being elastically deflectable with respect to the base;

each segment including a substantially planar reaction surface and a swaging surface;

the mandrel including a plurality of substantially planar engagement surfaces;

the engagement surfaces being slidably engageable with the reaction surfaces to deflect the segments between a collapsed position and an extended position, the segments in the extended position being structured to swagingly engage the first member; and the mandrel being rotatably disposed on the support and self-alignable with the reaction surfaces according to the rotational position of the collet with respect to the other of the housing and the piston.

20. The machine of claim 19 wherein the collet is threadably adjustable among the plurality of rotational positions with respect to the other of the housing and the piston.

21. The machine of claim 20 wherein the collet is lockable in at least one of the plurality of rotational positions with respect to the other of the housing and the piston.

22. The machine of claim 19 wherein the collet is substantially continuously adjustable among the plurality of rotational positions with respect to the other of the housing and the piston.

23. The machine of claim 19 wherein the machine is a substantially mobile handheld device.

* * * * *